US007458854B1

(12) United States Patent
Morgan

(10) Patent No.: US 7,458,854 B1
(45) Date of Patent: Dec. 2, 2008

(54) ELECTRICAL CONNECTOR AND TRANSMISSION LINE FOR MAINTAINING IMPEDANCE

(75) Inventor: Chad W. Morgan, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/869,376

(22) Filed: Oct. 9, 2007

(51) Int. Cl.
*H01R 4/66* (2006.01)

(52) U.S. Cl. ..... 439/608; 439/108

(58) Field of Classification Search ..... 439/608, 439/108, 101
See application file for complete search history.

(56) References Cited

U.S. PATENT DOCUMENTS 6,652,318 B1 * 11/2003 Winings et al. ..... 439/608
6,652,319 B1 11/2003 Billman
6,692,272 B2 2/2004 Llemke et al.
7,384,311 B2 * 6/2008 Sharf et al. ..... 439/608
2003/0220018 A1 * 11/2003 Winings et al. ..... 439/608
2006/0178025 A1 * 8/2006 Whiteman et al. ..... 439/108
2007/0099455 A1 * 5/2007 Rothermel et al. ..... 439/108
2007/0202747 A1 * 8/2007 Sharf et al. ..... 439/608

* cited by examiner

*Primary Examiner*—Gary F. Paumen

(57) ABSTRACT

An electrical connector for controlling impedance is provided. The electrical connector includes a lead frame that has a mounting edge and a mating edge and a dielectric support disposed therein. The electrical connector also has a signal conductor that is held within the lead frame and extends between the mounting and mating edges. The signal conductor includes an enclosed section that traverses the dielectric support and an exposed section that extends beyond the dielectric support. The signal conductor has cross-sectional dimensions that remain substantially constant throughout a length of the signal conductor. The electrical connector also includes a ground conductor that extends adjacent to the signal conductor. The ground conductor is contoured such that an outer surface of the ground conductor is spaced a first distance from the exposed section of the signal conductor and is spaced a second distance from the enclosed section of the signal conductor.

20 Claims, 7 Drawing Sheets

ELECTRICAL CONNECTOR AND TRANSMISSION LINE FOR MAINTAINING IMPEDANCE

BACKGROUND OF THE INVENTION

This invention relates generally to electrical connectors and transmission lines, and more particularly to electrical connectors and transmission lines that are configured to maintain impedance throughout the electrical path.

Electrical connectors and transmission lines provide an electrical path between two or more electronic devices or systems by using one or more signal conductors. Conventional electrical connectors can include single-ended or differential pair signal conductors and are typically designed to maintain a predetermined impedance. However, conventional connectors are generally not configured to correct impedance mismatches that may occur, for example, when the conductors traverse dielectric materials that have different dielectric constants At least one electrical connector has been proposed for maintaining the impedance in connectors while traversing materials that have different dielectric constants. The proposed electrical connector includes a lead frame that is made of a dielectric material having a dielectric constant. The lead frame holds a plurality of conductors which extend between and connect corresponding mounting contact terminals and mating contact terminals. The mating contact terminals project from one edge of the lead frame and are configured to connect to corresponding contacts of an electrical device, and the mounting contact terminals project from another edge of the lead frame and are configured to connect to corresponding contacts from another electrical device. The plurality of conductors include differential pair signal conductors and ground conductors that are located adjacent to the differential pairs.

In order to maintain impedance and the signal integrity, the wiring pattern formed by the conductors are held by the lead frame in the electrical connector. To hold the plurality of conductors, the lead frame uses several support bars that stretch across the lead frame. However, the impedance of the conductors is altered by transitioning from air to the dielectric material of the lead frame support bars. To counteract the change in impedance, the spacing between the signal conductors is increased or decreased. In particular, the signal conductors jog away from each other when the conductors enter the dielectric material. However, increasing the distance between the signal conductors increases the amount of space needed for the differential pair within the lead frame. Consequently, increasing the distance between the signal conductors reduces the total number of conductors that may be used within a lead frame of a predetermined size.

In another proposed electrical connector, similar to the one described above, the lead frame includes support bars that hold the signal conductors within the electrical connector. To counteract the change in impedance when the signal conductors traverse the support bars, the contour of the signal conductors are changed. More specifically, the signal conductors are narrowed. Reducing the width of the signal conductors not only decreases the amount of material used by the conductors, but also increases the distance between the signal conductors. Thus, changing the dimensions of the signal conductors can counteract the change in impedance. However, changing the dimensions of the signal conductors may attenuate the signal.

Thus, there is still a need for electrical connectors and transmission lines that maintain or control the impedance of the electrical path.

BRIEF DESCRIPTION OF THE INVENTION

In one embodiment, an electrical connector for controlling impedance is provided. The electrical connector includes a lead frame that has a mounting edge and a mating edge and a dielectric support disposed therein. The electrical connector also has a signal conductor that is held within the lead frame and extends between the mounting and mating edges. The signal conductor includes an enclosed section that traverses the dielectric support and an exposed section that extends beyond the dielectric support. The signal conductor has cross-sectional dimensions that remain substantially constant throughout a length of the signal conductor. The electrical connector also includes a ground conductor that extends adjacent to the signal conductor. The ground conductor is contoured such that the ground conductor is spaced a first distance from the exposed section of the signal conductor and is spaced a second distance from the enclosed section of the signal conductor.

Optionally, the signal conductor and the ground conductor are spaced apart the first distance before traversing the dielectric support and spaced apart the second distance when the ground conductor and the signal conductor traverse the dielectric support. Also, the second distance may be greater than the first distance.

In another embodiment, a transmission line for controlling impedance is provided. The transmission line includes a signal conductor that has cross-sectional dimensions that remain substantially constant throughout a length of the signal conductor. The transmission line also includes a dielectric support for holding the signal conductor within the electrical connector and a ground plane conductor that extends along and adjacent to the signal conductor. The ground conductor and the signal conductor are spaced apart a first distance in sections outside of the dielectric support and spaced apart a second distance in sections where the signal conductor traverses the dielectric support.

DETAILED DESCRIPTION OF THE INVENTION

Figure 1:
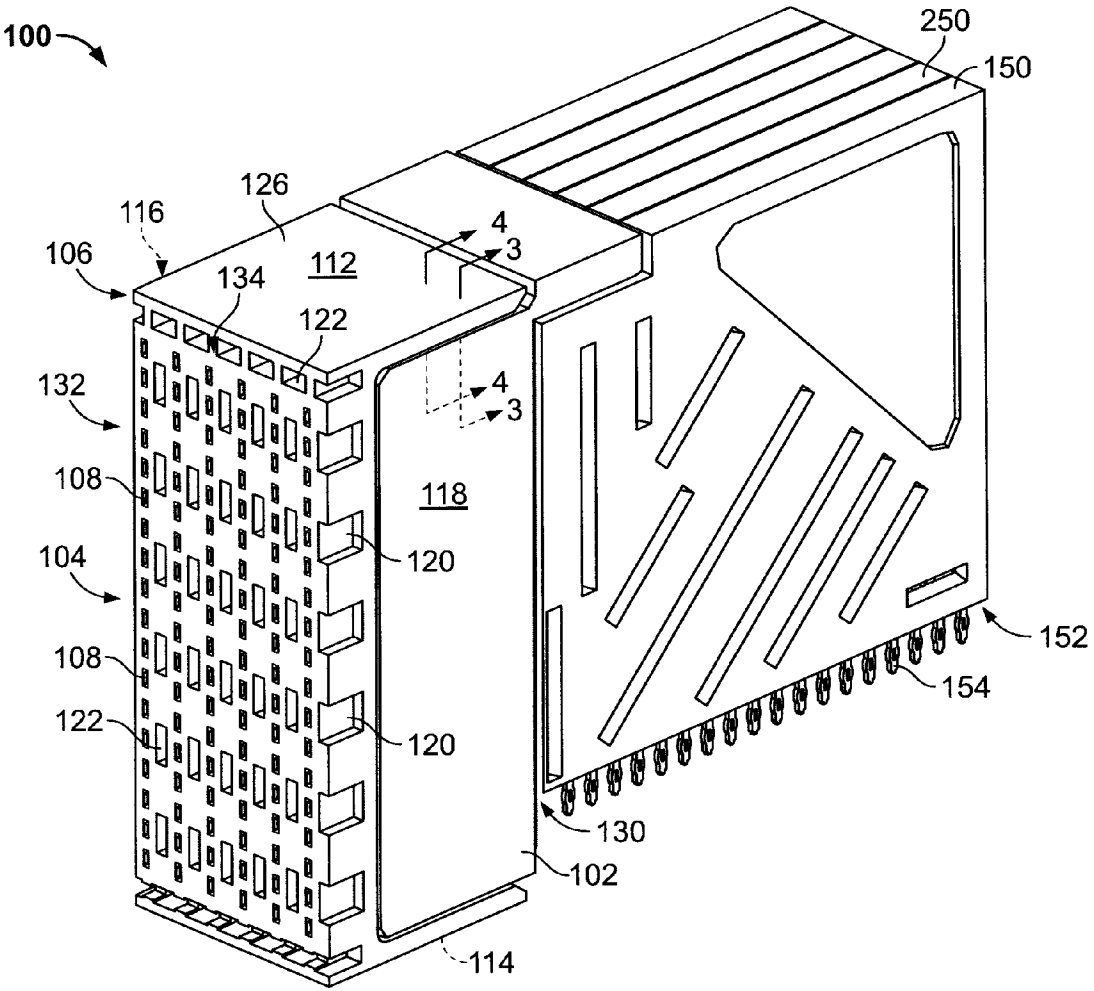
FIG. 1 illustrates an electrical connector formed in accordance with one embodiment.

FIG. 1 illustrates an electrical connector 100 formed in accordance with one embodiment. The electrical connector 100 includes a dielectric housing 102 having a forward mating edge or end 104 that includes a shroud 106. The mating end 104 includes a plurality of mating contact cavities 108 that hold a plurality of contact terminals 110 (shown in FIG. 2). The mating contact cavities 108 are configured to receive corresponding mating contacts (not shown) from an electrical component (not shown). The housing 102 includes an upper surface 112 and a lower surface 114 between opposing sides 116 and 118. The mating end 104 also includes a plurality of corner indentations 120 and alignment cavities 122. The corner indentations 120 and the alignment cavities 122 cooperate to bring the electrical connector 100 into alignment with the mating connector during the mating process so that the contacts in the mating connector are received by the contact cavities 108 and engage the contact terminals 110 (FIG. 2).

The housing 102 also includes a rearward extending hood 126. The housing 102 receives a plurality of contact module assemblies 150 and 250 at a rearward end 130. Each contact module assembly 150 includes a plurality of conductors 162 (shown in FIG. 2). The contact module assemblies 150 have a mounting edge or face 152 that includes a plurality of contact terminals 154, such as, but not limited to, pin contacts, or more particularly, eye-of-the-needle-type contacts, that are configured to be mounted to a substrate (not shown), such as, but not limited to, a circuit board. In an exemplary embodiment, the electrical connector 100 is a right-angle connector. More specifically, the mounting face 152 is substantially perpendicular to the mating end 104 such that the electrical connector 100 interconnects electrical components or devices (not shown) that are substantially perpendicular to one another. In alternative embodiments, however, the mating end 104 and the mounting face 152 may extend in any direction relative to each other. For example, the mating end 104 and the mounting face 152 may extend substantially parallel with respect to each other or form an oblique angle. In one embodiment, the housing 102 holds two or more different types of contact module assemblies 150 and 250 where the different types have, for example, different wiring patterns or electrical paths formed by the conductors 162 (FIG. 2). Alternatively, the housing 102 may hold only a single type of contact module assembly. Also shown in FIG. 1, the plurality of contact cavities 108 may be positioned to form a plurality of rows 132 and a plurality of columns 134. Each column 134 of contact cavities 108 corresponds to one contact module assembly 150.

Figure 2:
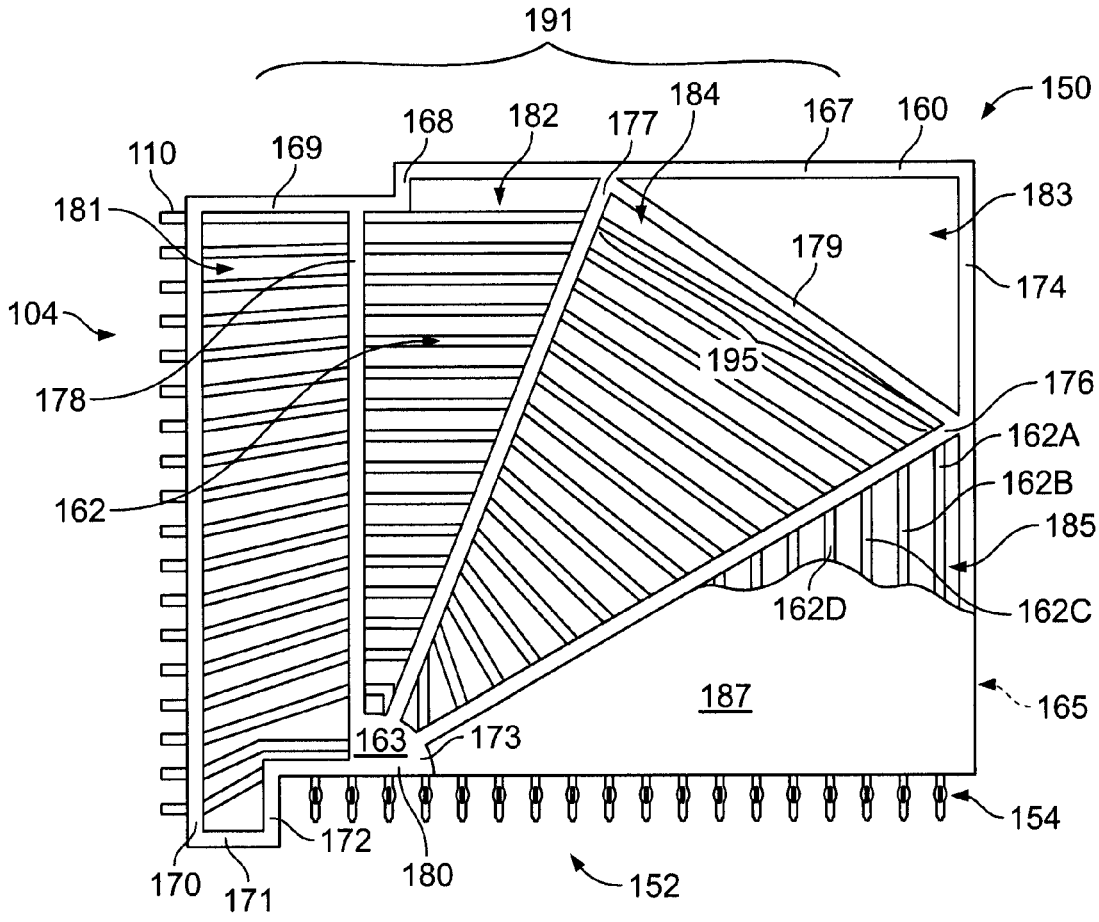
FIG. 2 is a side plan view of a contact module assembly that is used with the electrical connector shown in FIG. 1.

FIG. 2 is a side plan view of an exemplary embodiment of the contact module assembly 150. Although not discussed in detail, the contact module assembly 250 is similarly constructed as the contact module assembly 150 is described herein. The contact module assembly 150 includes a dielectric lead frame 160 that surrounds and holds the plurality of conductors 162. In some embodiments, the contact module assembly 150 includes a shield 187. (For illustrative purposes, only a portion of the shield 187 is shown.) The lead frame 160 may be manufactured using a molding process. Prior to molding the lead frame 160, the conductors 162 are stabilized by an integral carrier strip (not shown). During the molding process, a dielectric material is injected into a mold cavity that is shaped as the shape of the lead frame 160. After the dielectric material forms and is able to retain the desired shape, the integral carrier strip may then be removed and discarded.

In FIG. 2 the lead frame 160 may have a plurality of sides 167-174 that form an outer perimeter of the lead frame 160 and that include a mating side 170, a rear side 174, top sides 167-169, and bottom sides 171-173. As shown, the sides 167-169 form a top 191 and the side 173 forms the mounting face 152. The sides 170 and 174 extend upright between the top 191 and the mounting face 152. The lead frame 160 also includes a plurality of dielectric supports 176-179 that extend across a portion of the lead frame 160 and connect two or more sides, thereby providing structural support for the lead frame 160 and the conductors 162. More specifically, the side 173 includes a hub 180 from which the dielectric supports 176, 177, and 178 project. The dielectric support 178 extends from the hub 180 in a substantially perpendicular direction with respect to the side 173 and connects with the side 169 of the top 191. The dielectric support 177 extends from the hub 180 at an angle less than 90 degrees with respect to the side 173 and connects to the side 167. Likewise, the dielectric support 176 extends from the hub 180 at an angle less than 90 degrees and connects to the side 174. The dielectric support 179 extends from the top side 167 and connects to the rear side 174. As shown, the dielectric support 179 may connect to sides 167 and 174 where the dielectric supports 177 and 176 intersect sides 167 and 174, respectively. Although FIG. 2 illustrates one arrangement of sides and dielectric supports, alternative embodiments may have a variety of configurations that provide structural integrity for the lead frame and retain the conductors in the desired position and wiring pattern.

As shown in FIG. 2, the sides 167-174 and the dielectric supports 176-179 define a plurality of gap portions 181-185 therebetween. The conductors 162 may extend between the dielectric supports that define the corresponding gap portions. The gap portions 181-185 may contain ambient air, however, alternative embodiments may have the gap portions 181-185 filled with another dielectric material that has a dielectric constant different from the dielectric constant of the material used to form the lead frame 160. The sides 167-174 and the dielectric supports 176-179 may also include opposite surfaces 163 and 165 that extend substantially parallel to and along the lead frame 160 defining a width $W_{LF}$ (shown in FIGS. 3 and 4).

In the embodiment shown in FIG. 2, the lead frame 160 includes signal conductors 162A, 162B, and, 162D and a ground conductor 162C. However, the conductors 162 may be selected according to any desired wiring pattern. The adjacent signal conductors 162A and 162B may function as a differential pair where the ground conductor 162C separates the differential pair from another differential pair that includes the signal conductor 162D. As shown, the mating contact terminals 110 extend from the mating end 104 and the mounting contact terminals 154 extend from the mounting face 152. The conductors 162 extend along a predetermined path and interconnect the mating contact terminals 110 to the mounting contact terminals 154. The dielectric supports 176-178, bottom side 173, and mating side 170 cooperate in holding the conductors 162 in a fixed spatial relationship with respect to each other. More specifically, each conductor 162 includes an enclosed section 193 (shown in FIGS. 3 and 4) that traverses and is surrounded by the dielectric material of the supports 176-178 and sides 173 and 170. Each conductor 162 also includes an exposed section 195 that extends beyond the supports 176-178 and sides 173 and 170.

Moreover, when the electrical connector 100 includes differential pairs, it may be desired that each conductor of the differential pair have the same length. Although not shown in FIG. 2, each conductor 162 may have a unique path (e.g., by skewing) so that the lengths of corresponding differential pair signal conductors (e.g., 162A and 162B) are the same.

Figure 4:
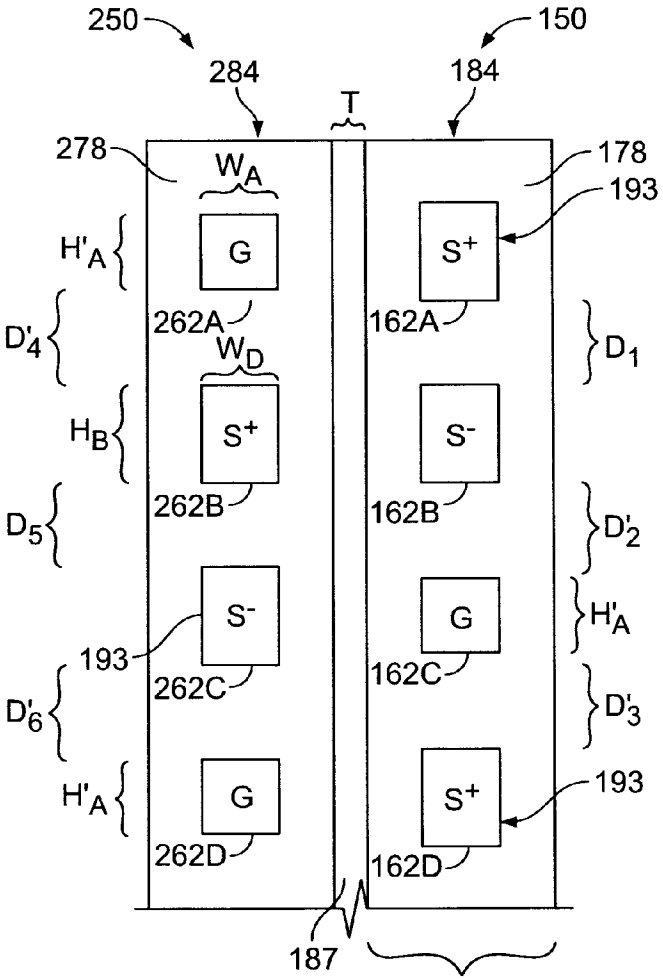
FIGS. 3 and 4 illustrate two adjacent contact module assemblies as conductors traverse dielectric material.
Figure 3:
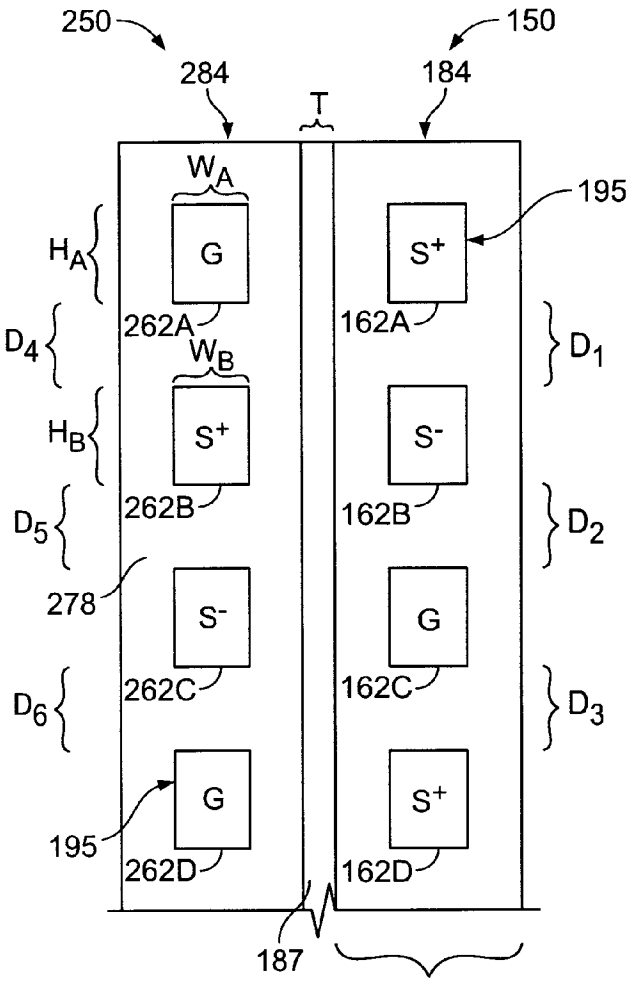

FIGS. 3 and 4 illustrate cross-sections of portions of two adjacent contact module assemblies 150 and 250 taken along lines 3-3 and 4-4, respectively, shown in FIG. 1. The contact module assembly 250 includes conductors 262A-262D and a dielectric support 278. More specifically, FIGS. 3 and 4 illustrate the cross-sectional dimensions of the exposed and enclosed sections 195, 193 of the conductors. FIG. 3 is a front view of a cross-section of the contact module assemblies 150 and 250 immediately before the conductors 162A-162D and 262A-262D, respectively, enter the dielectric supports 178 and 278, respectively. FIG. 4 is a front view of a cross-section of the contact module assemblies 150 and 250 as the conductors 162A-162D and 262A-262D, respectively, traverse the dielectric supports 178 and 278, respectively. As shown, the contact module assemblies 150 and 250 may be separated by the shield 187 having a thickness T. The shield 187 may be metallic or made from a dielectric material, such as the same material used in making the lead frame 160 (FIG. 2). Alternatively, the shield 187 may be omitted and the contact module assemblies 150 and 250 may be separated by air. Also, the thickness T or separation of the contact module assemblies 150 and 250 may be increased or decreased depending upon the desired electrical performance and configuration of the electrical connector 100 (FIG. 1). Furthermore, although FIGS. 3 and 4 refer directly to the dielectric supports 178 and 278, a similar description may be applied to the other supports (e.g., 176 and 177 in the contact module assembly 150).

The contact module assemblies 150 and 250 have a column 184 and 284, respectively, of spaced apart conductors 162A-162D and 262A-262D, respectively. In the exemplary embodiment, the electrical connector 100 (FIG. 1) includes differential pair signal conductors (indicated as S+ or S−) separated by ground conductors (indicated as G). More specifically, viewing from top to bottom, the column 184 includes the differential pair signal conductors 162A and 162B, the ground conductor 162C, and the signal conductor 162D which is part of another differential pair. Viewing from top to bottom, the column 284 includes a ground conductor 262A, differential pair signal conductors 262B and 262C, and another ground conductor 262D. Although not shown, the columns 184 and 284 continue in this sequence (G, S+, S−, G, S+, S−, G, et sequens). In this arrangement, the ground conductors in column 284 are laterally adjacent to S+ signal conductors and the ground conductors in column 184 are laterally adjacent to S− signal conductors. However, many different arrangements of the conductors 162 and 262 may by made. For example, there may be two ground conductors in between each differential pair. The conductors may then be arranged so that each of the two signal conductors is laterally adjacent to a ground conductor. As another example, the differential pairs could be formed by laterally adjacent conductors. As such, the differential pairs would be horizontally arranged in rows.

It is desirable to control the differential impedance to match the impedance of the electrical devices (not shown) that the electrical connector 100 (FIG. 1) is connecting. The differential impedance profile is determined by a number of factors, including the dimensions of the conductors, the position of the conductors with respect to each other, and the dielectric properties of the material that holds the conductors. With respect to FIG. 3, each conductor 162A-162D and 262A-262D has a rectangular cross-section including a width W and a height H (only shown with reference to conductors 262A and 262B). As shown in FIG. 4, when the conductors 162A-162D and 262A-262D transition into the dielectric supports 178 and 278, respectively, the cross-sectional dimensions of the ground conductors 262A, 262D, and 162C change while the cross-sectional dimensions of the signal conductors 262B, 262C, 162A, and 162B remain substantially constant. For example, in FIG. 3, each conductor 162A-162D is separated a distance D from an adjacent conductor prior to passing through the dielectric supports 178 and 278. More specifically, 162A is a distance $D_1$ apart from 162B, which is a distance $D_2$ apart from 162C, which is a distance $D_3$ apart from 162D. Likewise, 262A is a distance $D_4$ apart from 262B, which is a distance $D_5$ apart from 262C, which is a distance $D_6$ apart from 262D. In FIG. 3 the distances $D_1$-$D_6$ are approximately equal, however, the distance D may vary depending upon the desired electrical performance. As illustrated by FIG. 4, when the conductors 162A-162D and 262A-262D traverse the dielectric supports 178 and 278, respectively, the height of ground conductors 262A, 262D, and 162C reduces to height $H_4'$. Thus, the distances $D_2$, $D_3$, $D_4$, and $D_6$(FIG. 3) increase to $D_2'$, $D_3'$, $D_4'$, and $D_6'$ (FIG. 4). However, $D_1$ and $D_5$ remain substantially unchanged. As such, in one embodiment, the ground conductors 262A, 262D, and 162C have one cross-sectional area while traversing the exposed section 195 and another cross-sectional area while traversing the enclosed section 193.

Figure 5:
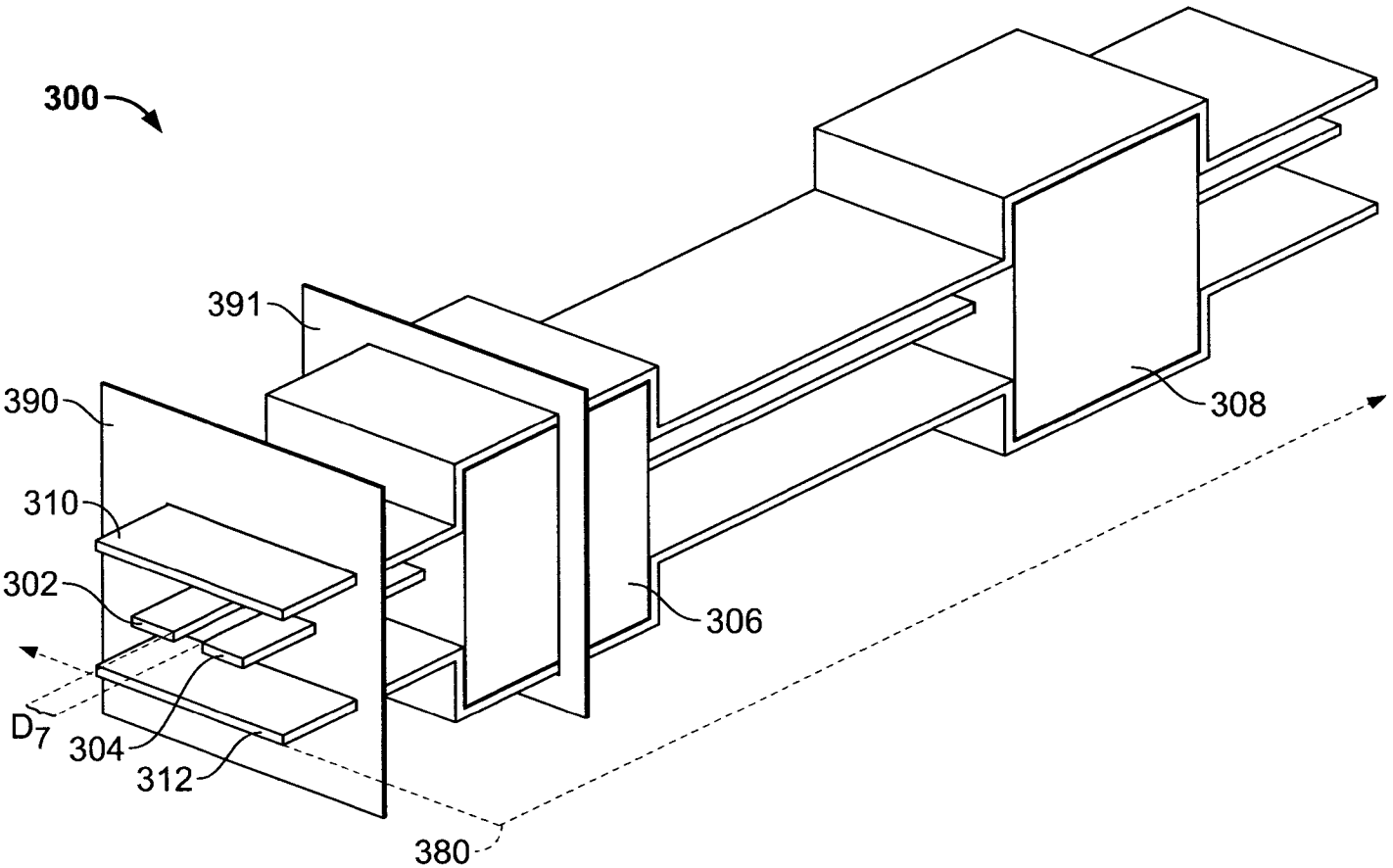
FIG. 5 illustrates a transmission line formed in accordance with another embodiment.

FIG. 5 illustrates a transmission line 300 formed in accordance with another embodiment. The transmission line 300 includes signal conductors 302 and 304, dielectric supports 306 and 308, and ground plane conductors 310 and 312. As shown in FIG. 5, the signal conductors 302 and 304 are substantially coplanar and define a plane 380 which extends through a center of the transmission line 300. In one embodiment, the transmission line 300 is a differential coplanar waveguide and the signal conductors 302 and 304 form a differential pair. In the transmission line 300, the signal conductors 302 and 304 traverse the dielectric supports 306 and 308, which facilitate holding the signal conductors 302 and 304 at a substantially constant distance $D_7$ apart. The ground plane conductors 310 and 312 extend along a path taken by the signal conductors 302 and 304 and are substantially parallel to the plane 380. When the signal conductors 302 and 304 traverse the dielectric supports 306 and 308, the ground plane conductors 310 and 312 circumscribe the dielectric supports 306 and 308. More specifically, the ground plane conductors 310 and 312 extend away from the signal conductors 302 and 304 and run along and against an outer surface of the dielectric supports 306 and 308.

Figure 6:
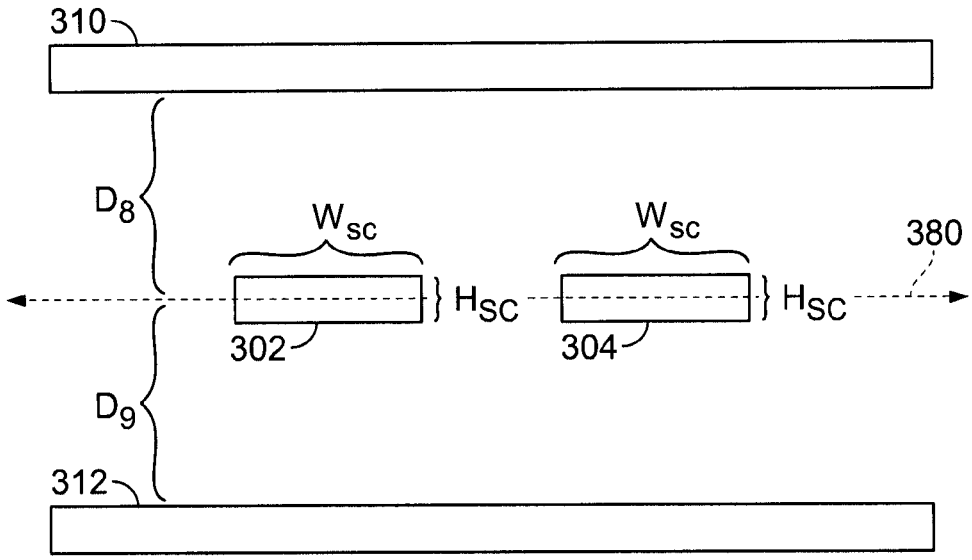
FIGS. 6 and 7 are cross-sections of the transmission line shown in FIG. 5.
Figure 7:
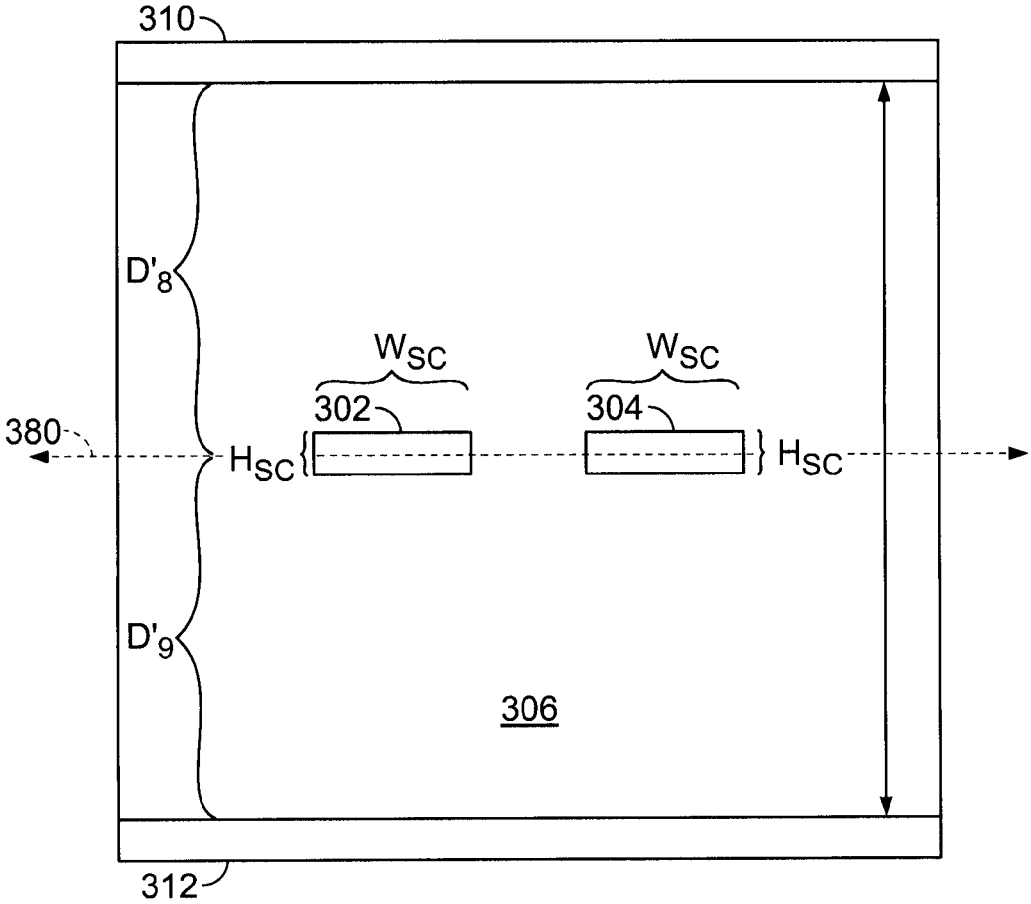

FIG. 6 is a cross-section of the transmission line 300 taken along the plane 390 in FIG. 5, and FIG. 7 is a cross-section taken along plane 391 in FIG. 5. The ground plane conductors 310 and 312 and the plane 380 formed by the signal conductors 302 and 304 (indicated as a dashed line) are substantially parallel. Also shown, the signal conductors 302 and 304 have a height Hsc and a width Wsc that remain substantially constant throughout a length of the signal conductors 302 and 304. In FIG. 6, the ground plane conductor 310 and the signal conductors 302 and 304 are spaced apart a distance $D_8$, and the ground plane conductor 312 and the signal conductors 302 and 304 are spaced apart a distance $D_9$. In one embodiment, the ground plane conductors 310 and 312 are substantially equidistant from the signal conductors 302 and 304 such that $D_8$ and $D_9$ are substantially equal. When the signal conductors 302 and 304 traverse the dielectric support 306, the separation between ground plane conductors 310 and 312 increases. More specifically, $D_8$ increases to $D_8'$, and $D_9$ increases to $D_9'$. As can be seen in FIG. 7, the ground plane conductors 310 and 312 remain substantially equidistant from the signal conductors 302 and 304. Moreover, the cross-sectional dimensions of the signal conductors 302 and 304 remain substantially constant while the signal conductors 302 and 304 traverse the dielectric support 306.

As shown in FIGS. 6 and 7, in the exemplary embodiment, the signal conductors 302 and 304 are spaced apart from the ground plane conductors 310 and 312 the distances $D_8$ and $D_9$ (FIG. 6), respectively, in sections outside of the dielectric support 306 or 308, and spaced apart the distance $D_8'$ and $D_9'$ (FIG. 7), respectively, in sections where the signal conductors 302 and 304 traverse the dielectric support 306 or 308. However, the signal conductors 302 and 304 are not required to be equidistant from the ground plane conductors 310 and 312, but may be closer to one ground plane conductor than the other. Also, although the dimensions of the ground plane conductors 310 and 312 appear unchanged in FIGS. 6 and 7, the cross-sectional dimensions for the ground plane conductors 310 and 312 may vary if desired.

Figure 8:
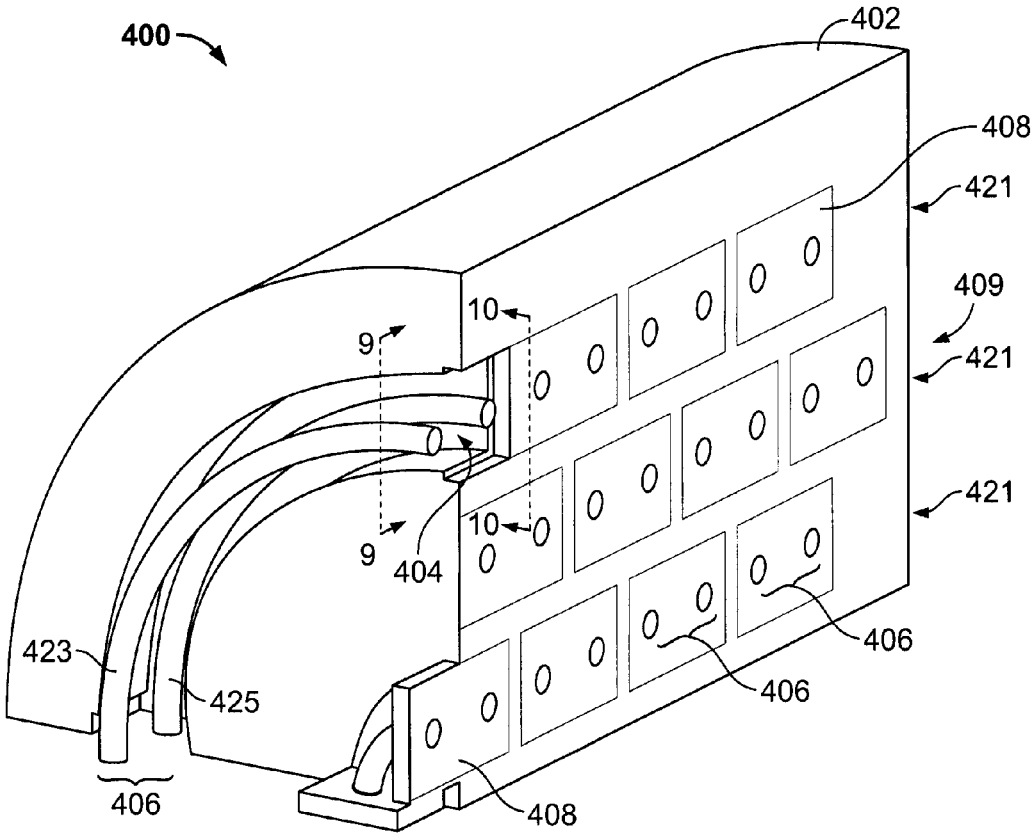
FIG. 8 illustrates an electrical connector formed in accordance with another embodiment.

FIG. 8 illustrates an electrical connector 400 formed in accordance with another embodiment. The electrical connector 400 includes a material block 402 having a plurality of passages 404. The material block 402 may be fabricated from a metal alloy, plastic, and/or metallized plastic. Also, the material block 402 and passages 404 may be formed by a mold process or the material block 402 may be machined to form the passages 404. The electrical connector 400 also includes a plurality of differential pairs 406 that extend through the passages 404 and includes dielectric supports 408 that hold the respective differential pair 406 within the passage 404. Each differential pair includes signal conductors 423 and 425. Alternatively, a single-ended conductor may extend through the passage 404. Although FIG. 8 only shows the dielectric support 408 at the end of the passage 404, other dielectric supports 408 may be used to hold the differential pair 406 within the passage 404. Moreover, the conductors 423 and 425 of each differential pair 406 may extend through the dielectric supports 408 and form contact terminals (not shown), such as the contact terminals 110 or 154 shown in FIG. 2.

As shown, the conductors 423 and 425 have a twin-axis relationship in that the conductors 423 and 425 are aligned side-by-side. More specifically, the conductors 423 and 425 have substantially equal length, dimensions, and electrical paths. Because the length of the electrical path should be equal with differential pair signal conductors, the twin-axis relationship enables embodiments of the electrical connector 400 to be made where skewing the conductors to make the length substantially equal is not necessary. Also shown, the differential pairs 406 form a conductor array 409 that includes a plurality of rows 421. Within each row 421, the differential pairs 406 are spaced apart from one another with a portion of the material block 402 separating the laterally adjacent dielectric supports 408. As shown in FIG. 8, the dielectric supports 408 of one row 421 are staggered with respect to the dielectric supports 408 of the immediately adjacent row(s) 421. As such, the conductors 423 and 425 of the differential pairs 406 form a row-and-column grid of conductors. If desired, the conductors 423 and 425 may be arranged such that the adjacent conductor is oppositely charged. In alternative embodiments, the dielectric supports 408 of each row 421 are not staggered with respect to the dielectric supports 408 of vertically adjacent rows 421.

Figure 9:
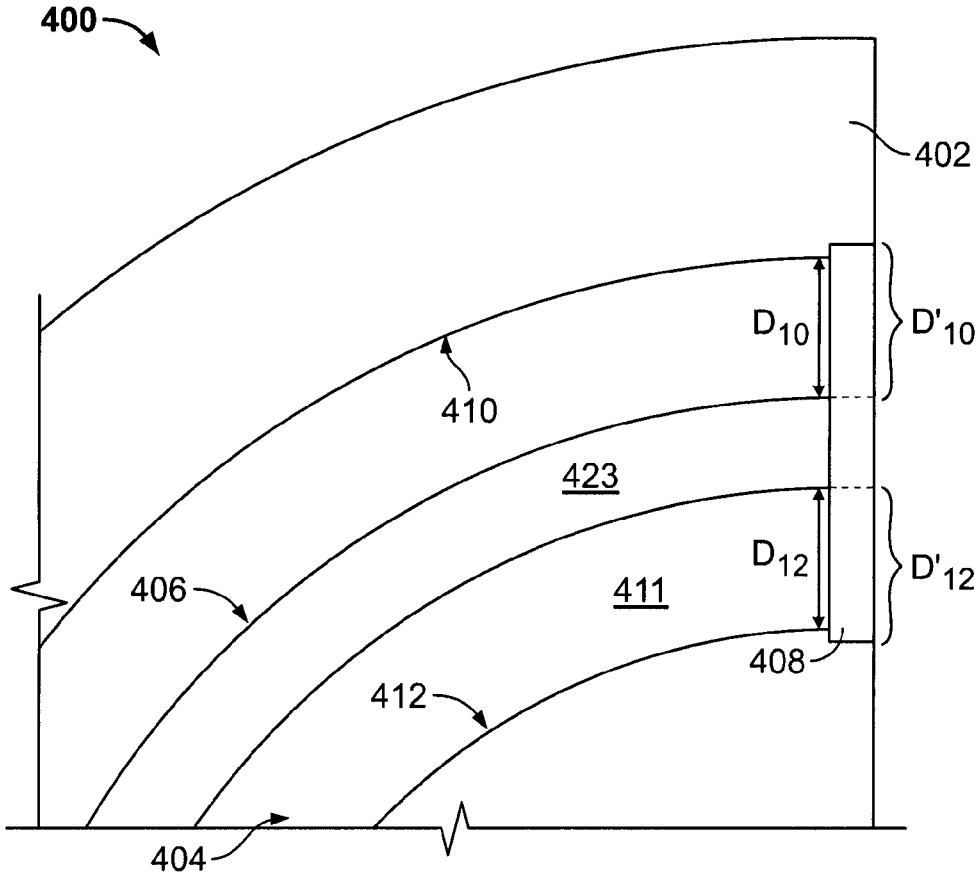
FIG. 9 is a side view of the electrical connector in FIG. 8 taken along the line 9-9 in FIG. 8.
Figure 10:
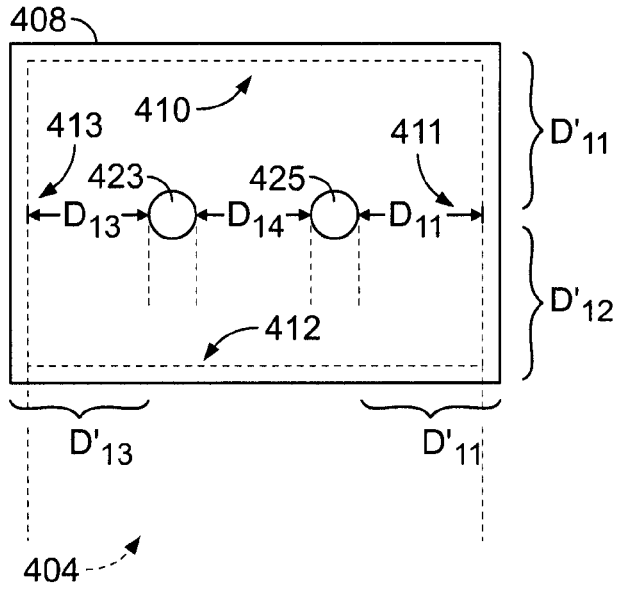
FIG. 10 is a front view of a dielectric support used with the electrical connector shown in FIG. 8.

FIG. 9 is a side view of the differential pair 406 in the passage 404 taken along the 9-9 line in FIG. 8, and FIG. 10 is a front view of the dielectric support 408 taken along the line 10-10 in FIG. 8. The dielectric support 408 has been added to FIGS. 9 and 10 for illustrative purposes. The passage 404 may have a substantially rectangular shape and include four outer walls 410, 411, 412, and 413 (FIG. 10). The outer walls 410-413 may be coated with a metal alloy for grounding the differential pair 406 such that the differential pair 406 is surrounded by metal. Alternatively, the walls may be fabricated from a metallized plastic. In one embodiment, the outer walls 410-413 are arranged to surround the differential pair 406. As shown in FIG. 9, the outer walls 410-413 may be connected to each other such that the outer walls 410-413 completely surround or enclose the differential pair 406. Alternatively, the passage 404 may have one outer wall having a substantially circular shape that surrounds the differential pair 406.

The differential pair 406 extends through a center of the passage 404 such that each conductor 423 and 425 (FIG. 10) is a vertical distance $D_{10}$ and $D_{12}$ (FIG. 9) from outer walls 410 and 412, respectively. Also, as shown in FIG. 10, the conductor 423 may be a horizontal distance $D_{13}$ from the outer wall 413, and the conductor 425 may be a horizontal distance $D_{11}$ from the outer wall 411. When the differential pair 406 begins to traverse the dielectric support 408, the outer walls 410-413 widen. More specifically, each conductor 423 and 425 of the differential pair 406 is a vertical distance $D_{10}'$ from the outer wall 410 and a vertical distance $D_{12}'$ from the outer wall 412. Moreover, the conductor 423 is now a horizontal distance $D_{13}'$ from the outer wall 413, and the conductor 425 is a horizontal distance $D_{11}'$ from the outer wall 411. However, as shown in FIG. 10, a distance $D_{14}$ between the conductors 423 and 425 remains substantially constant.

Embodiments of the electrical connector 100, the contact module assembly 150, lead frame 160, and transmission line 300 described and/or illustrated herein facilitate maintaining and/or controlling the impedance when the electrical conductors traverse materials having different dielectric properties. Moreover, the embodiments of the electrical connector 100, the contact module assembly 150, lead frame 160, and transmission line 300 described and/or illustrated herein are selectively configurable such that different patterns of signal, ground, and/or power conductors may be used.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector for controlling impedance comprising:

a lead frame having a mounting edge and a mating edge and comprising a dielectric support disposed within the lead frame;

a signal conductor held within the lead frame and extending between the mounting and mating edges, the signal conductor having an enclosed section traversing the dielectric support and an exposed section extending beyond the dielectric support, the signal conductor having cross-sectional dimensions that remain substantially constant throughout a length of the signal conductor; and a ground conductor extending adjacent to the signal conductor, the ground conductor being contoured such that an outer surface of the ground conductor is spaced a first distance from the exposed section of the signal conductor and is spaced a second distance from the enclosed section of the signal conductor.

2. The electrical connector in accordance with claim 1 wherein the signal conductor and the ground conductor are spaced apart the first distance before traversing the dielectric support and spaced apart the second distance when the ground conductor and the signal conductor traverse the dielectric support.

3. The electrical connector in accordance with claim 1 wherein the second distance is greater than the first distance.

4. The electrical connector in accordance with claim 1 wherein the signal conductor is a first signal conductor and the electrical connector further comprises a second signal conductor, the second signal conductor extending adjacent to the ground conductor.

5. The electrical connector in accordance with claim 4 wherein the first and second signal conductors form a differential pair.

6. The electrical connector in accordance with claim 5 wherein the ground conductor is a first ground conductor and the electrical connector further comprises a second ground conductor extending adjacent to at least one of the first and second signal conductors, wherein the differential pair is between the first and second ground conductors.

7. The electrical connector in accordance with claim 4 wherein the first and second signal conductors have a twin-axis relationship.

8. The electrical connector in accordance with claim 1 wherein the ground conductor has a length and a cross-sectional dimension that varies along the length.

9. The electrical connector in accordance with claim 1 wherein the lead frame is a first lead frame and the electrical connector further comprises a second lead frame comprising a signal conductor and a ground conductor, the second lead frame positioned adjacent to the first lead frame.

10. The electrical connector in accordance with claim 1 wherein the ground conductor comprises a plurality of ground conductors extending adjacent to the signal conductor, the plurality of ground conductors surrounding the signal conductor.

11. The electrical connector in accordance with claim 1 wherein the first and second distances are configured to facilitate maintaining impedance through the electrical connector.

12. A transmission line for controlling impedance, the transmission line comprising:

a signal conductor having cross-sectional dimensions that remain substantially constant throughout a length of the signal conductor;

a dielectric support for holding the signal conductor; and a ground plane conductor extending along and adjacent to the signal conductor, wherein the ground plane conductor and the signal conductor are spaced apart a first distance in sections outside of the dielectric support and spaced apart a second distance in sections where the signal conductor traverses the dielectric support.

13. The transmission line in accordance with claim 12 wherein the second distance is greater than the first distance.

14. The transmission line in accordance with claim 12 wherein the signal conductor is a first signal conductor and the transmission line further comprises a second signal conductor, the second signal conductor extending adjacent to the ground plane conductor.

15. The transmission line in accordance with claim 14 wherein the first and second signal conductors extend substantially parallel to each other such that the first and second signal conductors form a plane that is substantially parallel to the ground plane conductor.

16. The transmission line in accordance with claim 14 wherein the first and second signal conductors form a differential signal pair.

17. The transmission line in accordance with claim 14 wherein the ground plane conductor is a first ground plane conductor and the transmission line further comprises a second ground plane conductor that extends with the first ground plane conductor, wherein the first and second signal conductors are positioned between the first and second ground plane conductors.

18. The transmission line in accordance with claim 14 wherein the first and second signal conductors have a twin-axis relationship.

19. The transmission line in accordance with claim 12 wherein the first and second distances are configured to facilitate maintaining impedance through the electrical connector.

20. The transmission line in accordance with claim 12 wherein the ground plane conductor comprises a plurality of ground plane conductors extending adjacent to the signal conductor, the plurality of ground plane conductors surrounding the signal conductor.

* * * * *